United States Patent [19]

Morris et al.

[11] 4,045,827

[45] Sept. 6, 1977

[54] COMBINATION LAVATORY AND TOILET ASSEMBLY

[75] Inventors: Earl L. Morris, Whittier; Larry D. Fields, La Puente, both of Calif.

[73] Assignee: Acorn Engineering Company, Industry, Calif.

[21] Appl. No.: 747,521

[22] Filed: Dec. 6, 1976

[51] Int. Cl.[2] ..... A47K 4/00

[52] U.S. Cl. ..... 4/3; 4/2; 4/10; 4/DIG. 2

[58] Field of Search ..... 4/10, 9, 8, 12, DIG. 2, 4/6, 7, 97, 168, 166, 12, 13, 167, 2, 169; 248/419, 424, 278, 274

[56] References Cited

U.S. PATENT DOCUMENTS

| | | | |
|---|---|---|---|
| 971,826 | 10/1910 | Burkhardt | 4/DIG. 2 |
| 2,202,486 | 5/1940 | Fredrickson et al. | 4/DIG. 2 |
| 2,443,214 | 6/1948 | Williams | 4/DIG. 2 |
| 3,887,947 | 6/1975 | Tosca | 4/2 |

FOREIGN PATENT DOCUMENTS

| | | | |
|---|---|---|---|
| 587,691 | 1/1959 | Italy | 4/DIG. 2 |
| 840,528 | 6/1952 | Netherlands | 4/DIG. 2 |

*Primary Examiner*—Henry K. Artis
*Attorney, Agent, or Firm*—Ben E. Lofstedt

[57] ABSTRACT

A combination lavatory and toilet assembly including a sanitary enclosure having a rear side with a plurality of apertures therein, an upper side including means defining a lavatory basin with a drain opening therein and communicable with a plumbing drain pipe, a front side defining an access opening closed by a pivotally mounted closure member, a relatively pivotable toilet adapted to be stored in a first position within the enclosure and being pivotable about a generally vertical axis to a second position disposed exteriorly of the enclosure to permit use thereof, toilet support and pivot means fixedly coupled to the rear portion of the toilet for supporting the toilet and for pivotal movement between the first and second positions and including means for coupling the toilet to water supply piping and means for coupling the outlet of the toilet in fluid communication with the plumbing drain, wherein the toilet support and pivot means is supported independently of the enclosure, and linkage means operatively connected to the closure member and the toilet support and pivot means, whereby when the closure member is moved away from its closure position, the toilet is moved from the first position within the enclosure to a second position disposed exteriorly of the enclosure to permit use thereof when the closure member has been displaced no more than substantially 90° from its closure position.

28 Claims, 11 Drawing Figures

COMBINATION LAVATORY AND TOILET ASSEMBLY

BACKGROUND OF THE INVENTION:

1. Field of the Invention

This invention basically relates to combination lavatory and toilet assemblies, and, more particularly, to such assemblies which include an enclosure means for a toilet supported independently of the enclosure means means wherein the toilet is pivotally movable from within the enclosure to a position outside of the enclosure for use.

2. Description of the Prior Art

Numerous prior art assemblies have attempted to create a combination lavatory and toilet assembly which will fill the particular needs and requirements of certain institutional users of such plumbing assemblies, such as hospitals, hospital wards of penal institutions and similar facilites. This is especially true in intensive care units (ICU's) and coronary care units (CCU's).

Such institutional buildings have become so expensive to construct that the costs thereof are sometimes determined on a square inch basis rather than the more conventional square foot of floor space basis.

From this, it can be readily appreciated that the costs of such facilities can be significantly reduced if a portion of the low-frequency-of-use and high maintenance portions of these facilities can be eliminated, such as some lavatory and toilet facilities which are normally housed in totally separate and individual rooms.

One approach to solving this problem has involved the attempt to create a relatively adaptable combination lavatory and toilet assembly which may be placed within the user's room without the need to place these facilities in a totally separate room. If this can be conveniently and acceptably accomplished, both the original building construction costs and the on-going of maintenance can be significantly reduced.

Perhaps the first lavatory toilet combination assembly of this type is disclosed in U.S. Pat. No. 37,896 (Bissicks). The assembly of Bissicks provides a cabinet-enclosure, A, identified as a "case"therein, a wash-bowl B, a water closet C, a cover D for the water closet, and the appropriate water supply pipes and drain pipes. In order to reinforce the case A to permit proper support for the various pipes, water closet C and swivel F, a special bracket J is provided. The assembly of Bissicks, nevertheless, appears to possess a number of restrictive characteristics. The assembly of Bissicks does not provide any special means for moving the water closet in and out of the cabinet enclosure or case A. Presumably, the user of such an assembly is required to manually grab the water closet and swing it out of the cabinet to its position of use. Such a method is neither convenient nor sanitary. Further in a hospital, such a method is simply not acceptable for use by persons having physically debilitating infirmities. Further, the bracket J is used to support the water closet C, the swivel F and water supply pipe L, and, bracket J, is, in turn, supported by the case A. Accordingly, such requires that the case A must be strongly constructed to support not only these items, but also the weight of the user impressed upon the water closet C when in use. Another highly desirable feature not found in Bissicks is the capability of flushing the water closet regardless of the position of the water closet C. In Bissicks, water flushing occurs only when the water closet C is swung out of the case A. Additionally, the water flushing system provided by Bissicks is the continuous wash-out type which creates a relatively substantial amount of noise during the process of flushing; a highly undesirable feature for use in institutions, especially in hospitals.

Another combination lavatory toilet assembly is disclosed in U.S. Pat. No. 971,826 (Burkhardt). A toilet bowl A is pivotally secured to a ball-bearing sleeve joint 2 which is, in turn, mounted on a waste pipe 3 so that the bowl A may be swung in and out of a cabinet 4. This operation is accomplished by way of an operating level 28 which is operatively coupled to a link 27 and the bell crank 27′ which engages a fixed mutilated gear 24 which is engaged with a complementary segmental rack 25. The assembly of Burhardt provides that the operating lever 28 be operated independently of the door or the cabinet. Further, it should be noted that the ball-bearing pivot system for the toilet bowl A is supportively dependent with respect to the drain coupling to the waste pipe. Burkhardt fails to incorporate a trap in the toilet bowl A and is unacceptable by virtually all modern plumbing codes because of sewer gas (primarily methane gas, which is both toxic and flammable) leakage into the building housing the toilet bowl A. The toilet is supported completely by the buildings' plumbing via the waste pipe 3. Due to the nature of the Burkhardt invention, it is not adaptable for use with a wall mounted waste drain pipe. Also, the toilet bowl A cannot be flushed independently of the position of the bowl A. In this case, it cannot be flushed while in its stored position. In the event that the bowl A is flushed by pulling handle 30 while in its stored position, due to the fact that the drain opening 29 is closed in this bowl position, the water entering the bowl A cannot exit the drain opening 29 and the water will overflow the bowl A. Burkhardt also employs continuous washout flushing which is relatively noisy and undesirable for institutional use.

Yet another similar combination is embodied in U.S. Pat. No. 2,443,214 (Williams). The invention of Williams is functionally quite similar to that disclosed by Burkhardt. However, the following differences should be noted. The hopper 29 or toilet is mechanically coupled to the doors 3,4 so that when one of the doors is opened, the toilet is presented for use. However, like Bissicks and Burkhardt, Williams requires that the waste drain piping of the building provide the requisite support for the hopper 29. Williams further requires that the mechanical linkage be attached directly to the hopper 29 or toilet necessitating the use of non-standard hoppers. The water flushing sequence is not adaptable to modern usage in that the hopper is filled with water when presented for use and subsequently automatically flushed when returned to its stored position in the cabinet or wall partition. In essence, therefore, the flushing of the hopper 29 is not independent of the position of the hopper 29. And, still further, the combination of Williams is not adaptable for use with a wall-mounted waste drain and does not employ an enclosure independent from another supportive structure such as the wall of the building, as in this case.

Another combination enclosure and toilet assembly is disclosed in a German Pat. No. 840,528 (Oerther). In comparing the invention of Oerther to other units, while Oerther discloses the use of a closure or door member, it does not teach the use of a mechanical linkage therebetween to provide concommitant presentment of the toilet therewith. Further, the waste drain pipe is utilized to partially support the toilet. The highly desirable capability of being able to flush the toilet independently of the position of the toilet is provided by the invention disclosed by Oerther.

More recently, the Heintz Division of Kelsey-Hayes, a subsidiary of Fruehauf Corporation, introduced a combination plumbing fixture embodying a pivotable toilet bowl storable within a cabinet enclosure. Identified as Kelsey-Hayes Duralav Model 700, this particular combination lavatory and toilet bowl comprises a cabinet enclosure with a water faucet and lavatory arranged on the upper portion thereof, and further, having a lower front open portion with doors covering the open portion, and a toilet bowl which is pivotally mounted to a support means coupled to the waste connection enabling the toilet bowl to be moved into and out of the cabinet. Movement of the toilet bowl is effectuated by means of a mechanical linkage interconnecting one of the doors with the body of the toilet bowl so that when the door is opened, the toilet bowl is moved out of the cabinet for use. A handle operated locking mechanism ensures that the toilet bowl is maintained in a fixed position when it is positioned outside of the cabinet for use.

However, a number of limitatins are found in this particular combination:

1. The mechanical linkage interconnecting one of the doors and the body of the toilet bowl is such that the door to which the linkage is connected must be pivotally moved more than 90° from its initial or closed position. Since it is highly desirable to have as compact a cabinet enclosure as possible, the door is vertically hinged along the vertical edge of the side of the cabinet. This door movement does not permit the cabinet to be placed against a corner formed by the walls of a building, thereby limiting the scope of its use in an institutional room.

2. The water flush supply pipe is independent of the toilet bowl support bearing/swivel unit thereby requiring a relatively large enclosure volume to house the water flush supply pipe for the toilet bowl and toilet bowl bearing/swivel unit.

3. The toilet bowl support bearing/swivel unit is fixedly secured to the cabinet for support, thereby requiring that the cabinet be of sufficient strength to support it, usually requiring additional cabinet weight, increased cabinet material expense and construction cost.

4. The waste drain pipe is formed as an integral part of the toilet bowl support bearing/swivel unit, thereby necessitating reinforcement and adding substantial weight and material cost thereto. But, more importantly, this reinforcement includes the use of metallic struts and braces, typically found of L or U shaped sheet metal channels. This reinforcement creates a cabinet interior which is virtually impossible to maintain in a sanitary, germ and bacteria-free condition. Such unsanitary conditions are totally unacceptable for hospitals, hospital wards in penal institutions, and especially in intensive care and coronary care units.

5. The waste outlet piping is arranged for fluid coupling only to a wall mounted waste drain. This, of course, reduces its use in numerous existing plumbing situations where a substantial number of waste drain plumbing pipes are floor mounted.

6. The water flush supply pipe which produces the flushing action and interconnects the flushing rim and trap, is mounted beneath the trap elbow of the toilet bowl. This not only creates a probable security problem, but also requires additional material thereby increasing the cost to manufacture the unit. Further, this particular arrangement increases the volumetric envelope of the unit, thereby concommitantly increasing the requirement for a larger enclosure.

7. The Kelsey-Hayes unit employs a flexible plastic hose to fluidly couple the flushing valve outlet to a rigid water receiving conduit. This is necessitated because the rigid water receiving conduit is mounted off-center with respect to the toilet bowl vertical pivot axis of the toilet bowl support and pivot unit. Consequently, the rigid water receiving conduit is caused to move laterally as the toilet bowl is moved in and out of the cabinet enclosure to allow this lateral movement to take place. Because of this fluid coupling arrangement, a substantial volume is used within the cabinet enclosure for this water supply connection.

Still further, none of the above prior art references included a foot-operated water control valve system for controlling the flow of water to the spigot of the lavatory. Manual, or hand-operated, water control valve systems are generally unacceptable because such manual controls, whether such controls are pushbuttons or handles, are unsanitary for hospital usage, where the present invention has found, and is finding, wide-spread application and use. For example, a surgeon preparing for surgery must wash his hands several times prior to performing the surgery. If, after washing his hands or arms, the surgeon must now touch a pushbutton or a handle to start or stop the flow of water to the lavatory basin, re-contamination of the hands or arms occurs, thereby resulting in an unacceptable unsanitary condition. In fact, some states have laws prohibiting such hand-operated controls in such situations. California is one such state.

Another reason is that in most institutional environments such as hospitals, the high frequency of emergency situations which develop in such institutions virtually demand a means for conveniently and rapidly activating the valve which controls the delivery of water to the lavatory basin.

One of the most important, if not in fact, the most important requirement of such a combination lavatory and toilet assembly is that it be so constructed as to be easily and readily maintained in a sanitary condition. The reason for this is quite understandable.

In all of the prior art combinations discussed herein, it may be readily seen that when the enclosure is required to support the toilet and the associated swivel and piping system, it must be reinforced to properly support same. Such reinforcement includes the use of metallic struts and braces throughout the inside of the cabinet enclosure. This results in cabinet interiors which are difficult, if not impossible to maintain in a sanitary condition, making these units unsuitable for installation in hospitals, hospital wards in penal institutions, and particularly in intensive care and coronary care units.

SUMMARY OF THE INVENTION AND OBJECTS

The present invention is generally directed towards a combination lavatory and toilet assembly which is adapted for particular application in hospitals, hospital wards of penal institutions, convalescent homes, and similar institutions, wherein extreme compactness of size and durability of construction is highly desired. More particularly, the present invention is directed toward a novel assembly of the aforementioned type wherein the toilet portion thereof is adapted to be moved to and from a concealed position within an enclosure, whereby the toilet may be stored in a location which is entirely concealed from view. At such time as it is desired to use the toilet, an access opening in the enclosure is exposed by opening a closure door, whereby the toilet is pivoted about a generally vertical axis from the stored position to a position extending exteriorly of the enclosure and locks in the open or "use" position. At such time as it is desired to again store the toilet, the closure door to the aforementioned access opening is pivoted to a closed position, resulting in the toilet concommitantly pivoting to its respective stored position. The entire assembly of the present invention has been designed so as to be extremely compact, whereby a minimum amount of floor space is utilized.

A yet another object of the invention is to provide a new and improved combination lavatory and toilet assembly which is capable of being conveniently coupled to water supply piping and waste drain piping which are installed in the wall or alternatively in the floor without modification of the fixture.

Another object of the present invention is to provide a new and improved assembly which may be mounted against a pair of walls forming a corner of a room.

It is still another object of the invention to provide a new and improved combination lavatory and toilet combination which is of extremely compact design but which will incorporate a conventionally designed sanitary elongated rim toilet bowl with full sanitary water coverage of the bottom of the bowl and a minimum of 5 inches clearance between the water and the rim to provide sanitary usage and confort to the user.

It is yet another object of the instant invention to provide a new and improved combination lavatory and pivotal toilet arrangement which may be economically manufactured and yet is of an extremely durable construction and will, consequently, have a long and effective operational life.

It is an object of the present invention to provide a combination lavatory and toilet assembly which is quiet in operation.

Another important object of the invention is to provide a combination lavatory and toilet assembly which incorporates a foot-operated water control system for delivery of the water to the lavatory basin.

Another important object of the invention is to locate the operating mechanism of the foot-operated valves below the bottom of the doors and below the floor of the cabinet so that the operating mechanism can be conveniently located in varying positions along on the front of the cabinet as required for the right hand, left hand and center position units without modifying the door construction, while concealing the water supply pipes beneath the floor of the cabinet and in back of the back panel of the cabinet so as to provide a cabinet interior which is free of the supply piping and, conseauently, is sanitary and easily maintainable in such a sanitary and odor-free condition.

Another important object of the invention is to support the toilet bowl assembly entirely from the floor with the enclosure totally free of the loading stress which occurs whch the toilet is in use. This permits the entire cabinet structure to be fabricated of inexpensive materials such as laminated wood or Formica®, whereby to provide for economy of production and an extremely maintenance-free and sanitary unit as required for use in hospitals, hospital wards in penal institutions, and particularly for installation in intensive care and coronary care units.

Another object of the present invention is to provide a cabinet structure which is readily fabricated of materials identical to pre-existing cabinet and room finishing materials of the hospital room to provide visual continuity, improved visual aesthetics and substantially reduce the period of convalescence in accordance with established concepts of color therapy. Recent research has proven that a colorful and harmonious atmosphere can contribute greatly to the patient's state of mind and can shorten the period of convalescence. Use of laminated wood such as Formica® in the cabinet provides an ability to match virtually all existing color schemes and textures.

Other objects, features and advantages of the present invention will become more readily apparent from the following detailed description, when taken in conjunction with the accompanying drawings.

Figure 8:
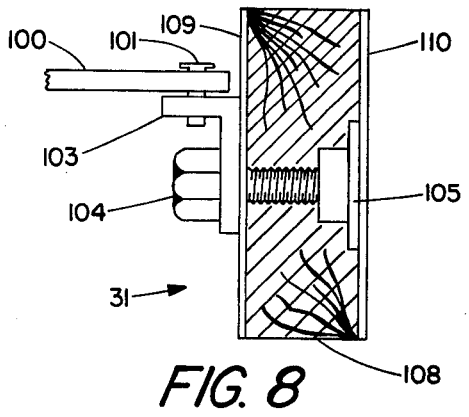
FIG. 8 is a view taken along Plane 8—8 of FIG. 6.
Figure 1:
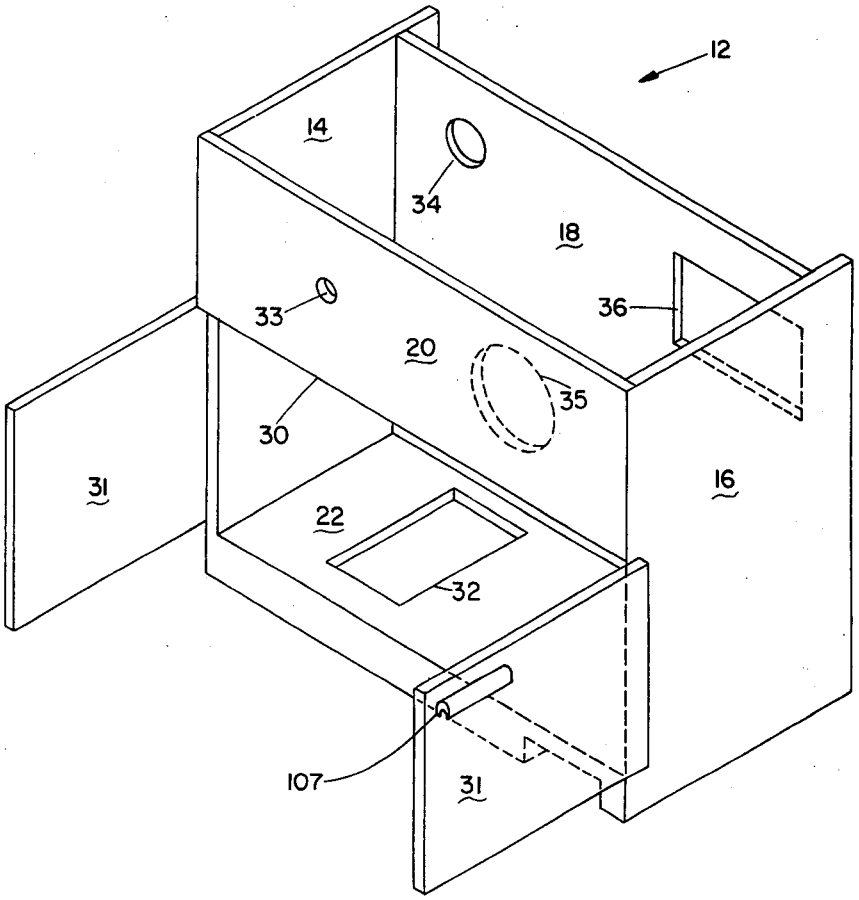
FIG. 1 is a perspective view of the cabinet enclosure portion of the present invention.

DESCRIPTION OF THE PREFERRED EMBODIMENT:

With continuing reference now to the drawings and in particular to FIGS. 1-3, 4 and 6, a combination lavatory and water closet assembly 10, in accordance with one preferred embodiment of the present invention, is shown generally as compromising an enclosure or housing 12 consisting of a pair of laterally-spaced ends 14 and 16, a rearward side 18, a forward side 20, a bottom side 22, and an upper side or top 24.

Generally speaking, the enclosure 12 is flexibly adapted to be mounted against a wall 111 having suitable water supply and drain piping therein, as will be readily apparent to those skilled in the art. Further, the enclosure 12 may, in the alternative, be positionally aligned with the floor 112 having suitable water supply and drain piping therein for coupling thereto.

However, it should be noted at this time, as will be evidently apparent as the description of the invention unfolds hereinafter, that the enclosure 12 does not require supplementary support, and in fact, is supportively isolated from other portions of the invention 10.

The enclosure 12 is adapted to house or contain a lavatory, generally designated by the numeral 26, and a toilet bowl, generally designated 28, the toilet 28 normally being stored and concealed interiorly of the enclosure 12 and being accessible through a suitable opening 30 which is closed, when the toilet 28 is not presented for use, by a pair of closure doors 31.

As will be readily apparent as the description of the present invention proceeds herein, the enclosure 12 is not required to be constructed of relatively strong and expensive stamped metal material, such as stainless steel, with substantial internal bracing therein, but may be suitably constructed of relatively low cost laminated structure of wood and plastic laminate materials which possess relatively long life, are generally maintenance-free and are easily maintained in the desired sanitary condition. Open metal bracing for reinforcing such a supporting cabinet enclosure such as found in the prior art forms many crevices within the enclosure 12 housing the toilet 28 and cannot be maintained in the requisite and necessary sanitary condition. It will be appreciated, of course, that various alternative materials may be utilized without departing from the scope of the present invention.

Other openings in the enclosure are provided for various and diverse purposes. For example, opening 33 through the forward side 20 provides for mounting a pushbutton 33 control (see FIG. 2) for flushing the toilet 28 as desired. The opening 34 in the rearward side 18 provides for fluid connection between the water supply piping of the building (not shown) and the toilet 28. Opening 32 extends over a portion of the bottom side 22 providing access for mounting the toilet 28 to the floor. Opening 35 in the rearward side 18 provides access for coupling the toilet 28 to a wall mounted or floor mounted waste drain. Opening 36 provides access for connection of water supply pipes and the waste drain conduit to the lavatory 26 through the rearward side 18.

Figure 3:
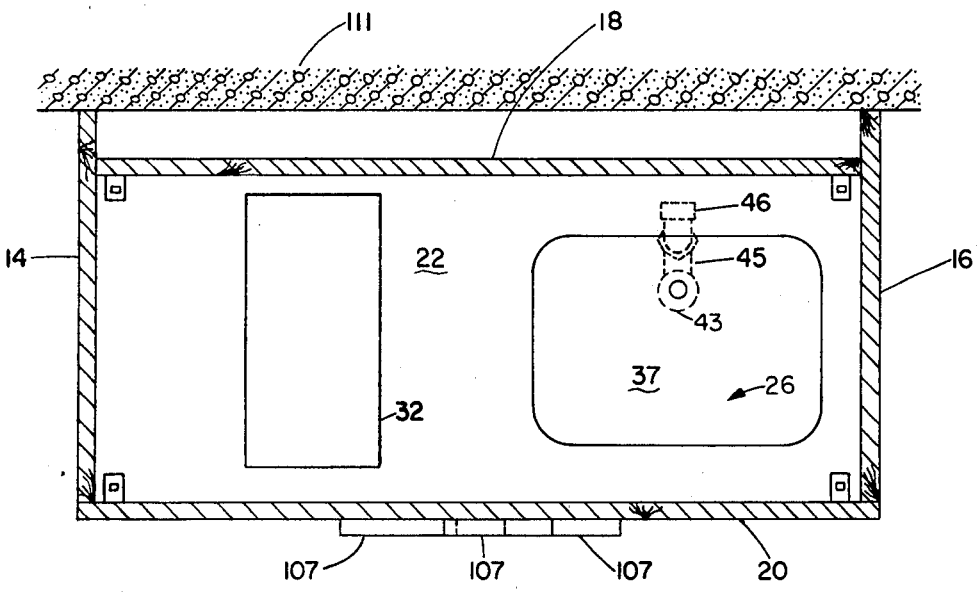
FIG. 3 is a view taken along Plane 3—3 of FIG. 2.
Figure 2:
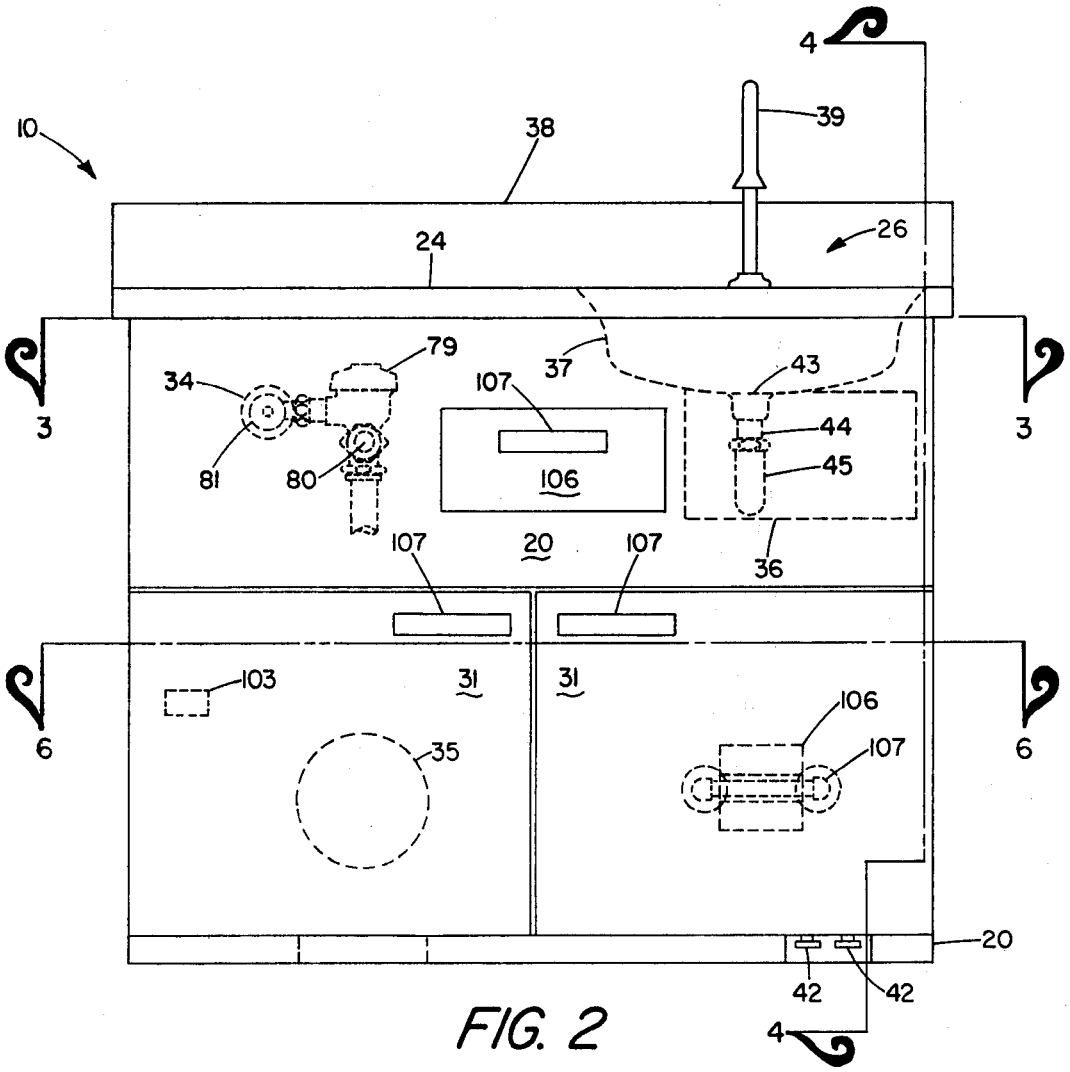
FIG. 2 is a front elevational view of the present invention depicting primarily the lavatory, the location of the toilet flush valve, the placement of the drawer, and the location of the roll of toilet tissue.
Figure 4:
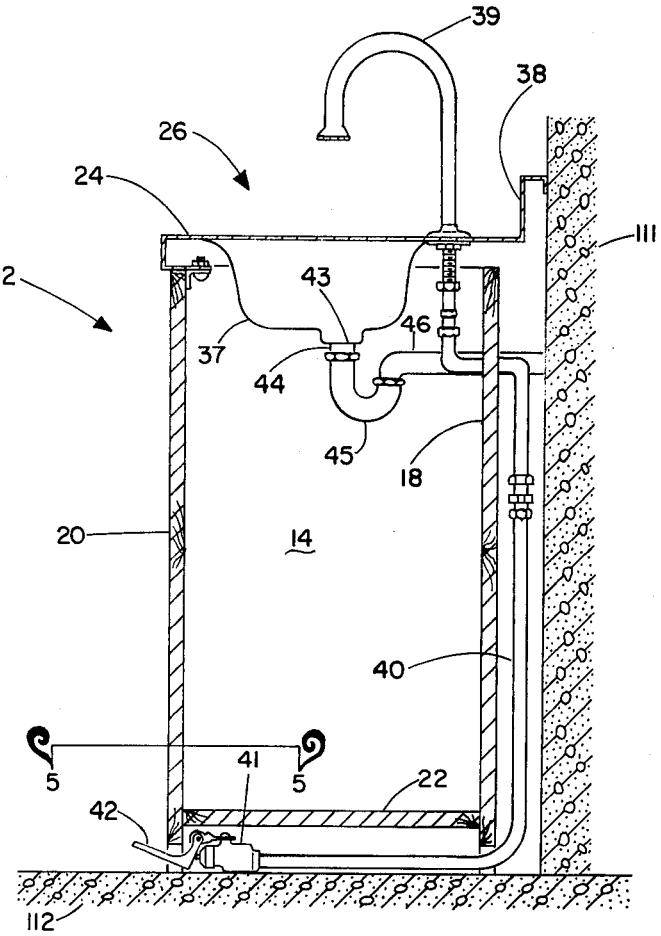
FIG. 4 is a view taken along Plane 4—4 of FIG. 2.
Figure 5:
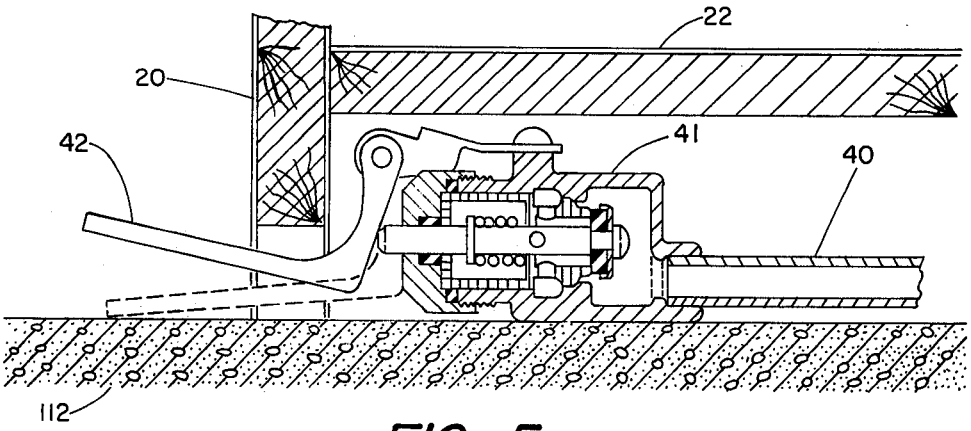
FIG. 5 is an enlarged cross-sectional view taken along Plane 5—5 of FIG. 4.

With special emphasis now on FIGS. 2,3 and 4, the lavatory 26 comprises a generally concave lavatory bowl 37 which is conveniently fabricated from a stamped metal, such as stainless steel, and secured to the upper side or top 24 of the enclosure 12 via an opening therein. In the alternative, as depicted specifically in FIG. 4 herein, the lavatory bowl 37 may be formed as an integral portion of the top 24 of the enclosure 12. The rearward edge of the top 24 of the enclosure 12 is provided with an upwardly extending splash board section 38 which serves as a water splash diverting surface to assist in preventing splashed water from flowing between the rearward side 18 and the wall 111 against which the rearward side 18 of the enclosure 12 may be disposed. As shown in FIG. 4, a water delivery nozzle 39 is provided and mounted through the top 24 between the rim of the lavatory 26 and the splashboard 38. A water supply conduit 40 is fluidly coupled to the water delivery nozzle 39 and is controlled by a foot pedal operated valve 41. As depicted in FIG. 5, the valve 41 may be conveniently constructed so as to provide a time-delayed closing function to permit the foot to be removed from the pedal 42 immediately following the depression or activation thereof without effectuating an immediate cessation of the flow of water therethrough. The lower end of the lavatory bowl 37 is provided with a drain outlet 43 which is communicable with a downwardly extending drain conduit 44 and a conventional trap 45, the trap 45, in turn, being communicable with a suitable drain outlet which is provided in the associated wall 111 partition or the like, such as shown at 45 in FIG. 3.

Figure 6:
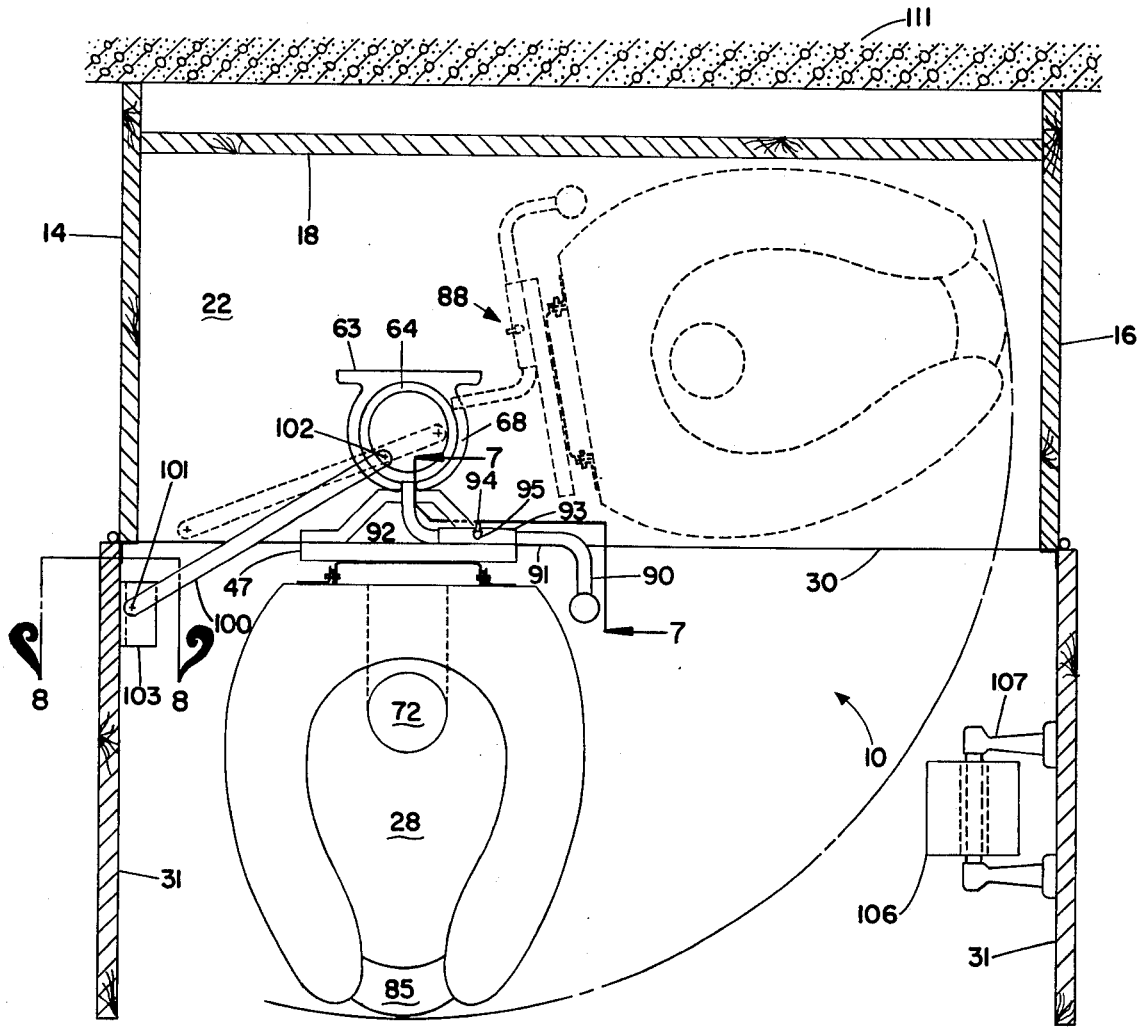
FIG. 6 is a view taken along Plane 6—6 of FIG. 2.
Figure 9:
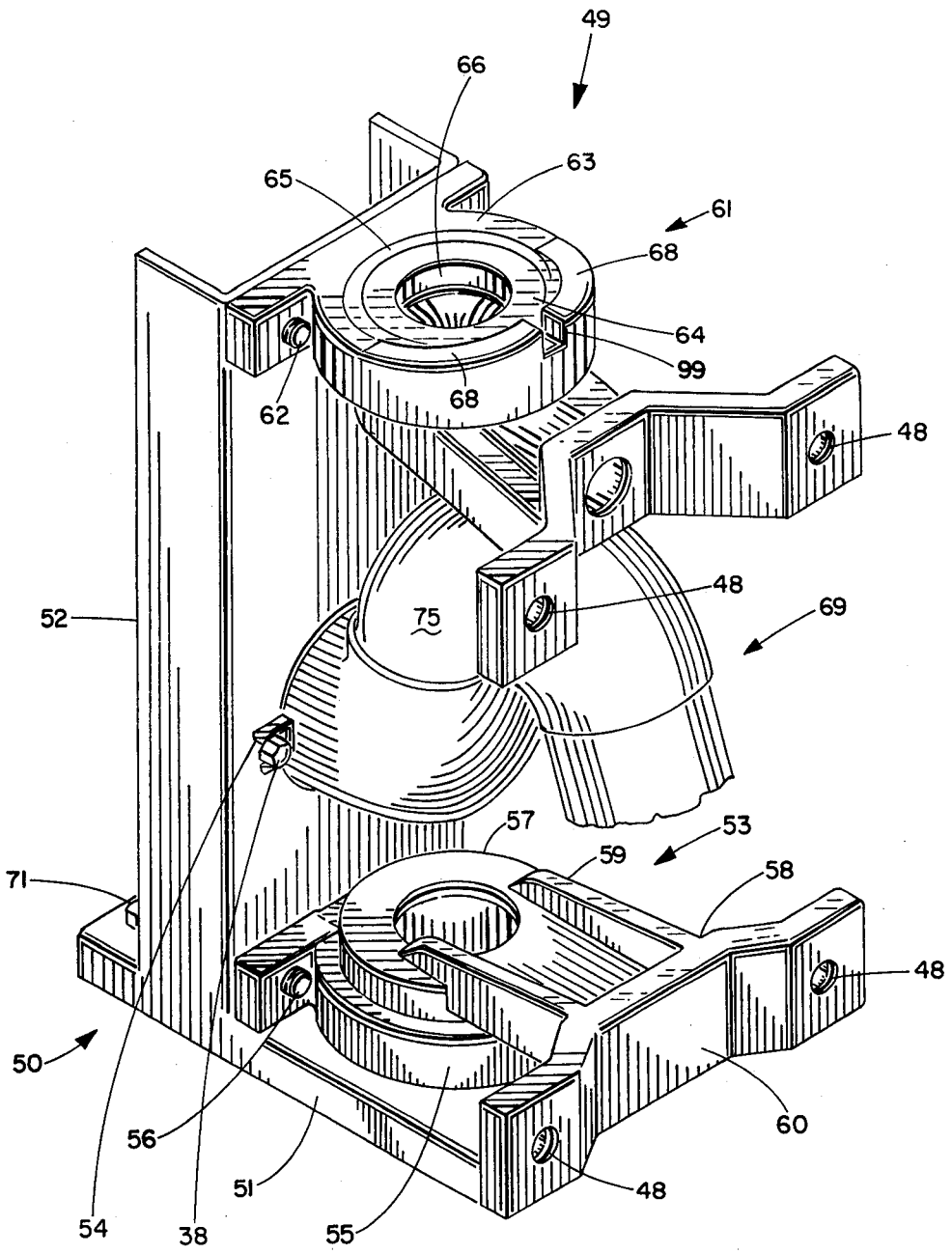
FIG.9 is a perspective view of the toilet bowl support and swivel unit which incorporates as an integral portion thereof, the water flush supply piping and the waste outlet of the toilet bowl.

With special emphasis now on FIGS. 6 and 9, the toilet 28 comprises a conventional sanitary toilet bowl that may be and is preferably fabricated of stainless steel or the like which includes a rearwardly disposed base 47 having apertures (not shown) therein alignable with the apertures 48 in the toilet bowl support and swivel unit 49 as depicted in FIG. 9 to permit the base 47 to be fixedly secured by bolts (not shown) or the like to the toilet bowl support and swivel unit 49 so as to be supported thereby. The toilet bowl 28 is supported by the toilet bowl support and swivel unit 49 (See FIGS. 6,9 and 10) in a manner such that the toilet 28 may be pivotally biased between the phantom line position shown in FIG. 6, whereby the toilet 28 may be normally stored interiorly of the enclosure 12 and may be pivotably biased to a position projected exteriorly therefrom, as depicted by the solid lines in FIG. 6, to a position projecting exteriorly therefrom during periods of use.

Figure 10:
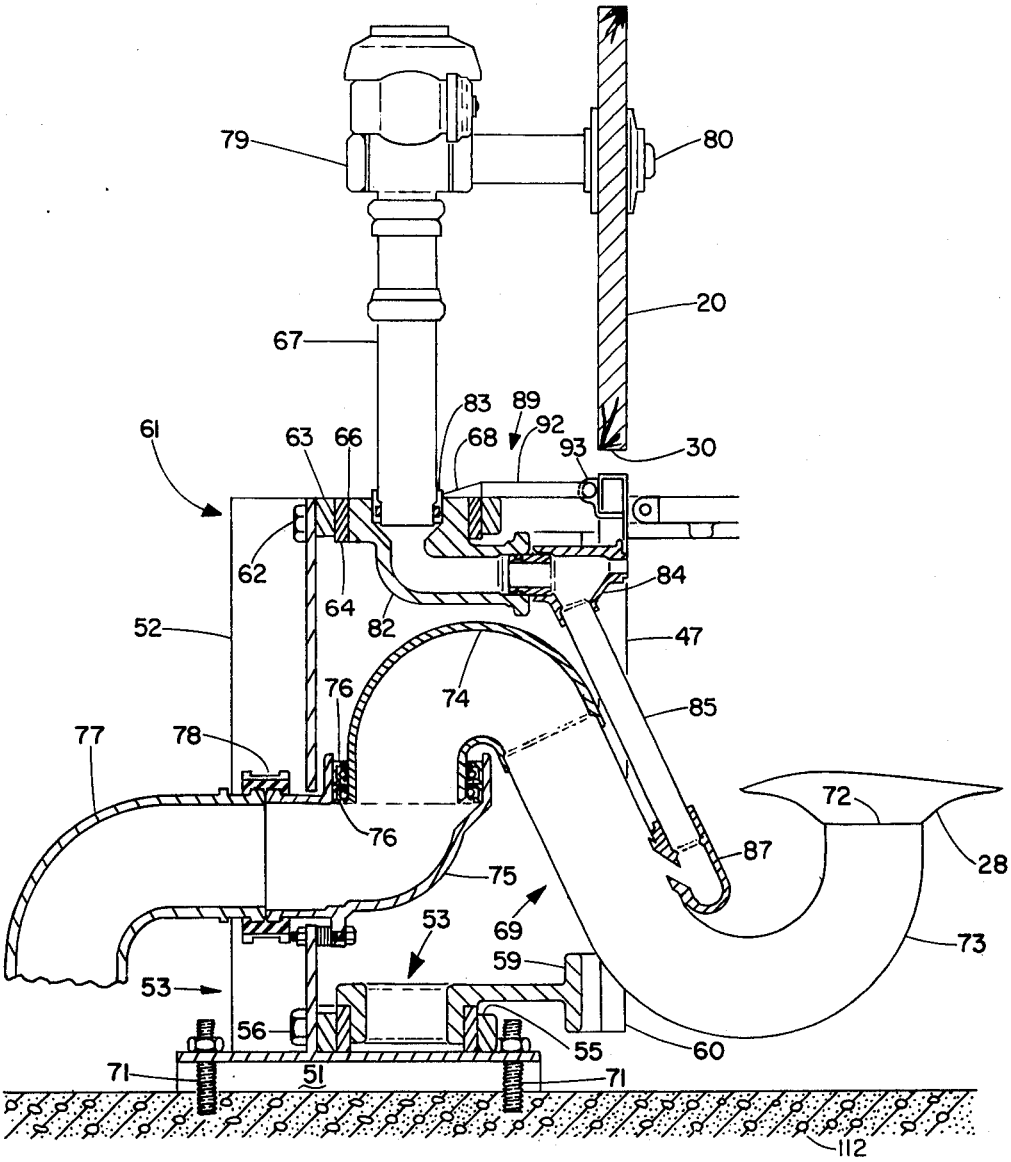
FIG. 10 is side elevational view of the unit of FIG. 9, in cross-section, depicting the structure thereof and the fluid coupling arrangement with the water flush supply piping and the waste drain outlet.

With continued reference to FIG. 9, the toilet bowl support and swivel unit 49 generally comprises a T-shaped mounting and support structure 50 including a horizontal base portion 51 and a vertical support portion 52, each of which is typically formed of a steel U channel member. A lower swivel bearing unit 53 is disposed on top of the horizontal base portion 51 and comprises a two-piece bearing mechanism. The lower portion of the two-piece bearing mechanism of the lower swivel bearing unit 53 is a stationary member 55 which is fixedly secured to the top of the horizontal base portion 51 by typically bolting it to the vertical support portion 52 by a pair of bolts 56 (only one is shown) secured thereto. The upper portion 57 is pivotably movable with respect to the stationary member 55 from side to side. Securely affixed thereto is a generally T-shaped member 58. The rearward portion 59 of the T-shaped member 58 is fixedly mounted to the upper portion 57 of the lower swivel bearing unit 53 with the forward portion 60 of the T-shaped member 58 having the apertures 48 therein through which the rearwardly disposed base 47 of the toilet 28 may be fixedly secured by means of bolts or the like. An upper swivel bearing unit 61 similar to the lower swivel bearing unit 53 is disposed adjacent to the topmost portion of the vertical support portion 52 and fixedly secured thereto by means of bolts 62 (only one is shown). The fixed or stationary portion is identified at 63; the movable portion is identified at 64. The movable portion 64 which is swivably coupled to the fixed portion 63 via a bearing unit 65 has a centrally disposed aperture 66 therein for receiving a water supply pipe 67 as shown in FIG. 10. A pair of wedge-shaped ramps 68 rim the forwardmost portions of the top side of the upper swivel bearing unit 61, the function of which will become readily apparent as the description of the invention proceeds further herein. Disposed between the upper swivel bearing unit 61 and the lower swivel bearing 53 is the waste drain conduit 69 from the toilet bowl 28. This particular conduit 69 is shown in greater detail in FIG. 10.

With particular emphasis now on FIG. 10, the horizontal base portion 51 is fixedly secured to the floor 112 via bolts 71. The drain outlet 72 of the toilet bowl 28 is coupled in fluid communication with one end of an elbow type P trap 73. The other end of the P trap is fixedly and sealingly coupled in fluid communication to one end of a J-shaped pipe 74. The other end of the J-shaped pipe 74 is arranged to be directed in a downwardly-facing fashion, and nestingly received into one of the open ends an elbow 75.

Figure 11:
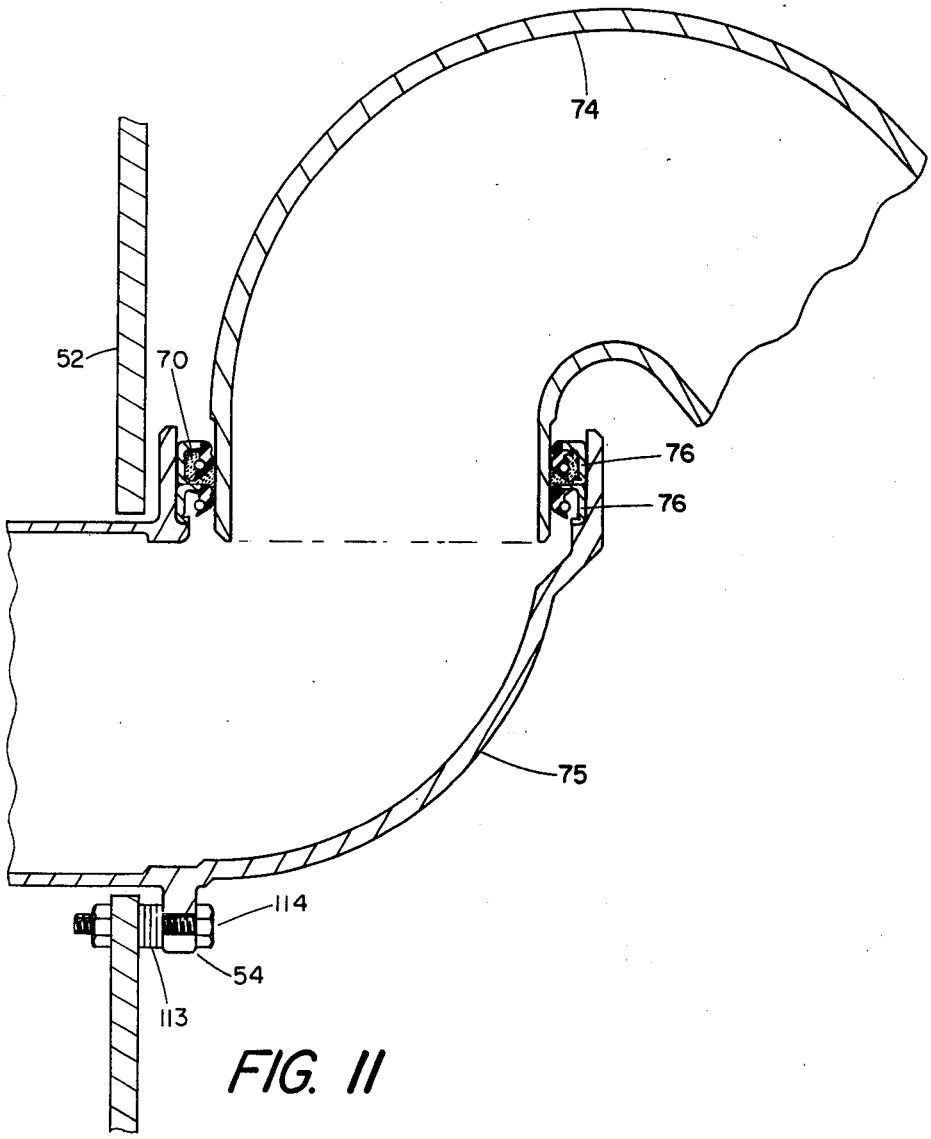
FIG. 11 is an enlarged view of the waste drain-to-toilet bowl outlet fluid coupling and swivel unit.

With special emphasis now on FIG. 11, there is shown circumferentially disposed about the downwardly-facing open end of the pipe 74, a pair of dynamic and static fluid seals 76, such as the oil seals manufactured by Chicage-Rawhide Industries, Inc., which are sealingly engaged between the open end of the elbow 75 and the pipe 74. A good quality lubricating grease 70 is generally placed between the oil seals to greatly increase the life expectancy thereof. Referring again now to FIG. 10, the other open end of the elbow 75 is fluidly coupled to the waste drain pipe 77. In this particular embodiment, this fluid coupling is accomplished by means of a no-hub connection 78.

With continued reference now to FIG. 10, a flushing valve 79 operable by means of a pushbutton 80 mounted to the forward side of housing 20 through the aperture 33. As clearly depicted in FIG. 2, the water supply pipe 81 is connected to the flush valve 79. Returning now to FIG. 10, the pipe 67 depending from flushing valve 79 interconnects the valve 79 and the elbow-insert 82. The elbow-insert 82 is fixedly inserted in frictional engagement with the rim of the aperture 66 in the upper swivel bearing unit 61 so as to be cooperatively movable, in contemporaneous fashion, with the movable portion 64 of the unit 61. Disposed between the pipe 67 and the elbow-insert 82 is a dynamic fluid sealing unit 83 having an O-ring seal thereabout to permit relative movement between the elbow-insert 82 and the water pipe 67 while maintaining a fluid seal therebetween. Coupled to the other end of the elbow-insert 82 is a Y coupling unit 84. One of the other open ends of the Y coupling unit 84 is fluidly coupled to a pipe 85; the other open end of the Y coupling unit 84 is fluidly coupled to the flushing rim 86 of the toilet bowl 28 to allow delivery of water thereinto. The other end of the pipe 85 is coupled via a water re-directing terminatiom member 87 to the trap 73 of the toilet bowl 28. When water flows into the water re-directing termination member 87, the water rushes into the lower portion of the trap 73, the end of which is coupled to pipe 74, thereby creating a syphonic-jet flushing turbulence in the trap 73 to create a significant fluid drawing action at the toilet bowl drain 72 to force the waste effluent from the toilet bowl 28 through the drain 72 and up and into and over the J-shaped pipe 74, the elbow 75, and into the waste drain pipe 77. Such syphonic jet flushing action produces considerably less noise than the continuous washout flushing cycle utilized in most toilet bowls to flush the effluent therefrom.

Figure 7:
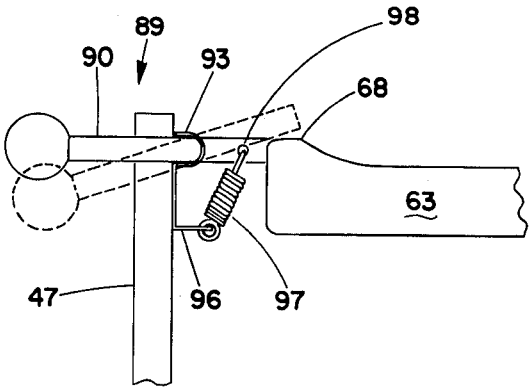
FIG. 7 is an enlarged view taken along Plane 7—7 of FIG. 6 depicting details of the locking mechanism for the toilet bowl.

With particular emphasis now on FIGS. 6, 7 and 10, a mechanism 88 is depicted therein for locking the toilet bowl 28 in a fixed position when presented for use outside of the enclosure 12. Basically, this locking mechanism 88 is quite simple. A rod member 89 having a forward-projecting handle portion 90, a transversely arranged body portion 91, and a rearwardly-directed portion 92 comprises one of the two major elements forming the locking mechanism 88. The other element is the ramp 68. Thr transversely-arranged body portion 91 is movably captured within a semi-tubular sheet metal member 93 which is fixedly secured to the rearwardly disposed base 47 of the toilet bowl 28. A pin 94 press-fitted into the body portion 91 is adapted to move in a transverse slot 95 to permit the radial movement of the body portion 91 but to eliminate any axial movement thereof, the purpose of which will become obvious as the description of this mechanism proceeds hereinafter.

A lower portion depending from the semi-tubular member 93 is a strip 96 having an L-shaped cross-section. A helically-wound spring 97 is securely anchored at one end through a hole 98 in the rearwardly-directed portion 92 of the locking mechanism 88 and is anchored at the other end through a hole (not shown) in the lowermost portion of the strip 96. The purpose of this spring 97 will become apparent as the description proceeds further herein.

The operation of the locking mechanism 88 may be briefly summarized as follows. The toilet 28 depicted by solid lines in FIG. 6 illustrates the locked position of the toilet 28. An enlarged view of the locking mechanism is shown in FIG. 7 and the locked position is shown in solid lines. With continuing reference now to FIGS. 6,7 and 9, when the rearwardly-directed portion 92 is disposed in the slot 99 which separates the pair of ramps 68, locks the toilet 28 in position for use. As shown in FIG. 7, when the forwardly projecting handle portion 90 is manually pushed downwardly to cause the rearwardly directed portion 92 to be elevated out of the slot 99, the locking mechanism 88 becomes disengaged or unlocked. Once this occurs, as clearly shown in FIG. 6, the toilet 28 may be pivotally moved into the cabinet enclosure 12 for storage purposes. In order to move the toilet 28 out of the enclosure 12 for use, the process is merely reversed. As the toilet 28 is moved out of the enclosure 12, the rearwardly-directed portion 92 rides up the ramp 68, causing the bias spring 97 to expand and to exert a bias force thereagainst. This bias force creates a frictional drag force to slightly reduce the speed of moving the toilet 28 for control purposes.

Movement of the toilet 28 in and out of the enclosure 12 is controlled by one of the closure members 31 which is mechanically linked to the top of the movable portion 64 of the upper swivel bearing unit 61. This mechanical link comprises an elongated member 100 having a pair of coupling pins 101, 102 pivotally coupled through the extremities of the elongated member 100, each of which is respectively and fixedly anchored to the closure member 31 via an L-shaped bracket 103, as shown in enlarged detail in FIG. 8, anchored to the closure member 31 via bolt 104 and threaded anchoring unit 105. Coupling pin 102 is similarly anchored to the top of the movable portion 64 of the upper swivel bearing unit 61.

As is readily seen in FIG. 6, when the closure member 31 is moved towards its closed position, the elongated member 100 is moved from the position identified in the solid line depiction to the phantom lined position.

A toilet roll 106 and its corresponding toilet roll tissue holder 107 is conveniently mounted on the other closure member 31 as is shown in FIGS. 2 and 6.

For purposes of convenience, a drawer 106 may be added for further flexibility and utility.

For safety purposes, all handles 107 are so formed that the fingers of one's hand cannot be inserted therethrough in the event that one were to fall or collapse while opening the closure members 31 or the drawer. A perspective view of one of the handles 107 is shown mounted on one of the closure members 31 in FIG. 1.

Reflecting once again on the enclosure 12, FIG. 8 cross-sectionally details the sandwiched structure which is desired in the construction of the enclosure 12. As is clearly shown therein, a central wooden layer 108 is shown sandwiched between hard plastic sheeting faces 109, 110, such as Formica®. To render the interior of the closure as easy to clean and sanitize as possible, the rearward side 18 of the enclosure 12 is disposed slightly forward of the rearwardmost vertical edges of the laterally-spaced ends 14 and 16. This permits the water supply piping 40 and similar piping to be disposed exteriorly of the enclosure 12 and to allow these edges to be positioned in intimate contact with the wall 111, should such positioning be desired, as clearly shown in FIGS. 3 and 4. As a result, a minimum amount of the piping is disposed within the interior portion of the enclosure 12 making such interior easier to maintain in a sanitary condition. For the same reason, the bottom side 22 of the enclosure 12 is arranged to be disposed above the floor 112 to allow the piping 40 and the valve 41 to be disposed exteriorly of the enclosure 12. This forms a low-cost, easily sanitized construction for the enclosure 12.

Additionally, with reference again to FIGS. 9, 10 and 11, for installation and alignment purposes, the elbow 75 has three slotted ears 54 mounted about the exterior thereof. Two of the ears 54 are laterally-spaced in opposite disposition to one another with the slots facing outwardly from the elbow 75. Only one of the laterally-spaced ears is shown in FIG. 9. These ears 54 are slideably engaged with a pair of bolts 38 which are threadably secured via appropriate threaded apertures in the vertical support portion 52 of the T-shaped mounting and support structure 50. By loosening and thereafterwards tightening these bolts, the elbow 75 may be adjusted in a side-to-side fashion. By inserting shims or washers therebetween, adjustments may be effected in a forward a rear fashion, as well as angular adjustment. Similarly, an ear 54 is provided on the underside of the elbow 75, with spacers or shims 113, is adjustably mounted via bolt 114, to vertical support position 52. This permits adjustments of the elbow 75 in a vertical plane. Both the lateral and vertical adjustments are necessary to ensure proper sealing alignment and engagement of the elbow 75 with the seals 76 and the J-shaped pipe 74.

As will be obvious to those skilled in the plumbing art, the enclosure 12 does not require mounting to a wall, such as wall 111 of FIG. 3 and 4, but since it is independently capable of separate support, it may be placed in a free-standing position away from a wall, as desired.

It is to be understood that the foregoing description is that of preferred embodiments of the invention. Various changes and modifications will readily occur to those skilled in the art to which this invention pertains without departing from the spirit and scope of the invention, the breadth and extent of which is to be defined by the claims appended hereto.

We claim:

1. A combination lavatory and toilet assembly, comprising:

a. an enclosure having a rear side with a plurality of apertures therein, an upper side including means defining a lavatory basin with a drain opening therein and communicable with a plumbing drain pipe, a front side defining an access opening closed by a pivotally mounted closure member;

b. a relatively pivotable toilet adapted to be stored in a first position within the enclosure and being pivotable about a generally vertical axis to a second position disposed exteriorly of the enclosure to permit use thereof;

c. toilet support and pivot means fixedly coupled to the rear portion of the toilet for supporting the toilet independently of the plumbing piping and for pivotal movement between the first and second positions and including:

means for coupling the outlet of the toilet in fluid communication with the plumbing drain; wherein the toilet support and pivot means is independent of the enclosure; and d. linkage means operatively connected to the closure member and the toilet support and pivot means, whereby when the closure member is moved away from its closure position, the toilet is moved from the first position within the enclosure to a second position disposed exteriorly of the enclosure to permit use thereof when the closure member has been displaced no greater than substantially ninety degrees from its closure position.

2. The combination of claim 1, further comprising a bottom side for said enclosure with an aperture therein.

3. The combination of claim 1, further comprising:

a. a first water supply delivery conduit for cold water;

b. a first foot-operated water control valve coupled in fluid communication with said water supply delivery conduit for cold water;

c. a water delivery nozzle mounted to said upper side of said enclosure adjacent said lavatory basin, the nozzle of which is disposed above and over said lavatory basin; and d. water piping means fluidly coupling said water control valve outlet to said water delivery nozzle.

4. The combination of claim 3, wherein said foot-operated water control valve is a time-delay closed valve.

5. The combination of claim 3, further comprising:

a. a second water supply delivery conduit for hot water;

b. a second foot operated water control valve coupled in fluid communication with said water supply delivery conduit for hot water;

c. water piping means fluidly coupling said hot water control valve outlet to said water delivery nozzle; and c. a water manifold means having a pair of inlets thereinto and an outlet therefrom, said outlet being coupled in fluid communication with said water delivery nozzle and one of said inlets being coupled in fluid communication with said cold water conduit coupled to the outlet of said cold water control valve and the other inlet being coupled in fluid communication with said hot water conduit coupled to the outlet of said hot water control valve.

6. The combination of claim 3, wherein said foot-operated water control valve and said water supply and piping means are disposed beneath said bottom side to improved the sanitary condition and the maintenance of said sanitary condition in the interior of said enclosure.

7. The combination of claim 3, wherein said water piping means fluidly coupling said hot and cold water control valve outlets to said water manifold means is disposed exteriorly of said enclosure beneath said bottom side and said rear side of said enclosure to eliminate the formation of increased surface area, crevices and the like to improve the sanitary condition and the maintenance of said sanitary condition in the interior of said enclosure.

8. The combination of claim 7 wherein said foot-operated valves may be positionally disposed beneath said bottom side of said enclosure and at any desired position on said front side of said enclosure said pivotally mounted closure member.

9. The combination of claim 1, wherein said enclosure is constructed of wood sheeting bonded between plastic sheeting, such as Formica®.

10. The combination of claim 9, wherein said wood sheeting is pressed wood.

11. The combination of claim 9, wherein said wood sheeting is plywood.

12. The combination of claim 1 wherein said pivotally mounted closure member includes a handle thereon for manually operating said closure member.

13. The combination of claim 12 wherein said handle is so constructed that the fingers of a hand cannot pass through said handle.

14. The combination of claim 1 further including locking means for automatically locking said toilet when said toilet is pivotally moved from within said enclosure to a forward position of use outside of said enclosure.

15. The combination of claim 14 further including means for manually releasing said locking means to permit said toilet to be pivotally biased and returned to a storage position within said enclosure.

16. The combination of claim 1, further including a water trap therebeneath and flushing means for said toilet, said flushing means introducing flushing fluid within said water trap directing sand flushing fluid towards the waste drain and causing the effluent in said toilet to be syphonically evacuated therefrom.

17. The combination of claim 1, further comprising a toilet tissue roll holder mounted to said closure member and facing the interior of said enclosure.

18. The combination of claim 1, further comprising a drawer operatively disposed through said front side of said enclosure.

19. The combination of claim 1 wherein said toilet support and pivot means comprises:

a. a horizontal base portion;

b. a vertical support portion having a plurality of apertures therein, one of said apertures being substantially larger than the other apertures, said vertical support portion being fixedly joined along its lower portion to said horizontal base portion intermediate the extremities of said horizontal base portion;

c. an upper swivel bearing unit including a bearing unit, a mounting member for said bearing unit, said mounting member being fixedly secured to the upper portion of said vertical support portion, a movable member, substantially T-shaped secured to said bearing unit for relative pivotal movement with respect to said mounting member and having means thereon for securing the rear portion of said toilet thereto, and aperture means in said movable member for passing a water piping system therethrough; and d. a lower swivel bearing unit including a bearing, a mounting member for said bearing unit, said mounting member being fixedly secured to the lower portion of said vertical support portion, a movable member, substantially T-shaped, secured to said bearing unit for relative pivotal movement with respect to said mounting member and having means thereon for securing the rear portion of said toilet thereto.

20. The combination of claim 19 further including means for anchoring said horizontal base portion to a floor.

21. The combination of claim 19, further including elbow piping means having an upper inlet portion and a lower outlet portion, thereof disposed within said vertical support portion via said largest aperture therein intermediate said upper and lower portions of said vertical support portion and further including mounting means for securing said lower outlet portion of said elbow piping means to said vertical support portion.

22. The combination of claim 20, further including toilet waste piping means coupled in fluid communication with said upper inlet portion for receiving the effluent from said toilet, said coupling including means for pivotal movement therebetween.

23. The combination of claim 22, wherein said means for pivotal movement between said upper inlet portion of said elbow piping means and said toilet waste piping includes a pair of oil sealing rings, disposed one above the other.

24. The combination of claim 23 further including grease lubricating means disposed throughout the chamber formed between said oil sealing rings and said upper inlet portion of said elbow piping means and said toilet waste elbow piping means.

25. The combination of claim 22 wherein said fluid communication between said upper inlet portion of said elbow piping means and said toilet waste piping means is continuous so that said toilet effluent may be evaluated therefrom independent of the position of said toilet.

26. The combination of claim 25 including a toilet flushing valve, means for delivering water to said flushing valve, pushbutton means disposed on the front side of said enclosure for operably controlling said toilet flushing valve, water conduit means pivotally coupled in fluid communication to said aperture means in said movable member of said upper swivel bearing unit, the opposite end of side water conduit means being fixedly coupling in fluid communication to the outlet of said toilet flushing valve, water manifold means fluidly coupling the outlet of said aperture means in said movable member of said upper swivel bearing unit for passing a water piping system therethrough to the flushing rim of said toilet and also to the water trap of said toilet for introducing flushing water within said water trap directing said flushing water towards the elbow piping means and thereby causing the effluent in said toilet to be syphonically evacuated therefrom.

27. The combination of claim 14 wherein said locking means comprises:

a. ramp means disposed on the forward portion of said upper stationary mounting member of said upper swivel bearing unit, said ramp means rising upwardly from the rearward-most portion to the forwardmost portion and thereafterwards dropping immediately to the original plane of the top of said upper swivel bearing unit;

b. rod means including a body portion and a rearwardly directed portion and a forwardly directed portion, said body portion being operably secured to the rear portion of said toilet so that the forwardly directed portion is movable upperwards and downwards thereby correspondingly causing said rearwardly directed portion to move in the direction opposite to the movement of said forwardly directed portion, said rearwardly directed portion being engageable over said ramp means whereby when said toilet is disposed substantially ninety degrees with respect to the front side of said enclosure, the rearwardly directed portion is caused to be disengaged from said ramp means and is disposed against the top of said upper swivel bearing unit; and c. spring biasing means to bias said rearwardly directed portion downwardly to direct engagement thereof with said ramp means and said upper swivel bearing unit.

28. The combination of claim 27 wherein said linkage means includes:

a. a rigid elongated member having a pair of apertures in the ends thereof;

b. a first pin means fixedly secured to upper swivel bearing unit, one of said apertures in said rigid elongated member being adapted to loosely fit thereover to form a pivotal coupling therewith;

c. bracket means affixed to the inside of said closure member adjacent said pivot mounting of said closure member to said enclosure and having a portion projecting outwardly therefrom and having an aperture therein; and d. a second pin means loosely coupling said bracket portion having an aperture therein, through said aperture, to the other aperture in said rigid elongated member to form a pivotal coupling therewith, so that when said closure member is moved away from its closure position, said toilet is moved from its first position within said enclosure to a second position disposed exteriorly of said enclosure to permit use thereof when said closure member has been displaced no more than ninety degrees from its closure position.

* * * * *